United States Patent [19]

Yamamoto et al.

[11] Patent Number: 4,505,956

[45] Date of Patent: Mar. 19, 1985

[54] LUBRICANT FOR TREATING SYNTHETIC FIBERS

[75] Inventors: Hisao Yamamoto; Osamu Kogiso, both of Gamagori, Japan

[73] Assignee: Takemotoyushi Co. Ltd., Aichiken, Japan

[21] Appl. No.: 456,018

[22] PCT Filed: Apr. 30, 1982

[86] PCT No.: PCT/JP82/00148

§ 371 Date: Dec. 27, 1982

§ 102(e) Date: Dec. 27, 1982

[87] PCT Pub. No.: WO82/03880

PCT Pub. Date: Nov. 11, 1982

[30] Foreign Application Priority Data

Apr. 30, 1981 [JP] Japan ..... 56-65439

[51] Int. Cl.[3] ..... D06M 13/20; D06M 13/16; D06M 13/40; C09K 3/16

[52] U.S. Cl. ..... 427/393.1; 252/8.8

[58] Field of Search ..... 252/8.8; 427/393.1

[56] References Cited

U.S. PATENT DOCUMENTS 3,888,775 6/1975 Koizumi et al. ..... 252/8.8
4,227,882 10/1980 Saito et al. ..... 8/128 R
4,294,711 10/1981 Hardy et al. ..... 252/174

FOREIGN PATENT DOCUMENTS 56-43493 4/1981 Japan ..... 252/8.8

*Primary Examiner*—Maria Parrish Tungol
*Attorney, Agent, or Firm*—Fred Philpitt

[57] ABSTRACT

This invention is directed to a lubricant for treating synthetic fibers characterized by adding a polyethylenepolyaminepolyacetic acid derivative of the following formula (I) to a composition comprising so far known lubricating agent and surfactant, and imparts lubricating property and antistatic property to synthetic fibers in the production and processing steps thereof:

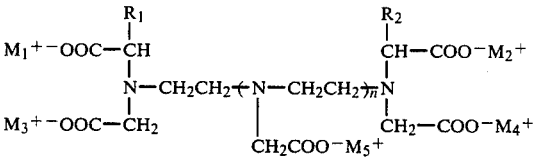

(I)

wherein $R_1$ and $R_2$ is hydrogen or an alkyl or alkenyl group of 1–22 carbon atoms; n is an integer of 0–4; and $M_1^+$–$M_5^+$ are respectively selected from the group consisting of hydrogen ion, alkali metal ion, and ammonium ion expressed e.g. by the following formula (II):

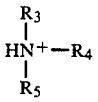

(II)

wherein $R_3$, $R_4$ and $R_5$ are respectively selected from the group consisting of hydrogen, alkyl, alkenyl, hydroxyalkyl, polyethoxyalkyl, polypropyleneoxyalkyl and polyethylenepolyaminoethyl.

4 Claims, No Drawings

LUBRICANT FOR TREATING SYNTHETIC FIBERS

FIELD OF THE ART

This invention relates to a novel lubricant for treating synthetic fibers which is suitable for applying a lubricant containing a specified compound to synthetic fibers to thereby impart a high extent of lubricating property and antistatic property to fiber filaments in the production step and the processing step of synthetic fibers and diminish various obstacles in the steps.

ART OF THE BACKGROUND

Generally in the case of thermoplastic synthetic fibers such as polyester, nylon, polypropylene, etc., a lubricant for treating fibers is attached to unstretched yarns obtained by melt-spinning, followed by stretching to 3 to 4 times the original length and heat-set for fixing the properties. The resulting stretched yarns are further passed through advanced processing steps such as bulky processing, twisting, warping, sizing, knitting, weaving, etc. to give fiber products, and in such production and processing steps, yarns are industrially treated very often at considerably high speed for improving their productivity; thus various obstacles accompanying the treatment such as attrition of guides, travellers, knitting needles, etc. contacting with filaments, various electric obstacles such as fiber-breakage due to approach of filaments at the time of warping, contact thereof with the second heater and twining round nip rolls in a false twist processing machine, etc. have become a more and more serious problem. Thus a fiber-treating lubricant capable of diminishing such obstacles has been earnestly required.

As an antistatic agent component for fiber-treating lubricants used in the production and processing steps of synthetic fibers, various kinds of anionic surfactants, cationic surfactants, amphoteric surfactants, etc. have so far been used in admixture, but those which satisfy all of problems of antistatic property, lubricating property to metals, the so-called lubricating property and collecting property such as high speed unwinding from pirn, cheese, etc., resistance to attrition of metals, and the like properties, have not yet been developed. Further, when lubricants using such ionic surfactants are made up into an aqueous emulsion to be applied to fibers, the resulting foam is too large, resulting in adhesion unevenness of lubricants; hence development of an antistatic agent having little foaming property has been particularly awaited.

Further, surfactants as the above-mentioned component being currently most often used for the antistatic purpose are anionic surfactants, but those having properties which fully satisfy the above-mentioned purpose under a severe condition of an atmosphere of extremely low humidity (RH: 30% or lower), have not yet been found. For example, as anionic surfactants used so far, there are alkali metal salts or alkanolamine salts of long-chain alkyl phosphates, which, however, have drawbacks of being liable to wear frictional bodies as described above and lowering antistatic property at the time of high temperature heat treatment or at the time of low humidity. Further, surfactants of alkylsulfate salt or alkylsulfonate salt type exhibit superior antistatic property under an atmosphere of high humidity or medium humidity, but they are not yet fully satisfactory under an atmosphere of extremely low humidity (RH: 30% or lower), and if the amount thereof added is increased in order to supplement the insufficiency of the property, their lubricating property becomes notably inferior, and further, when they are dissolved in water, their emulsion causes a notable foaming due to reduction in the surface tension.

Furthermore, aliphatic carboxylic type anionic surfactants represented by alkali metal salts of oleic acid or ricinoleic acid exhibit desirable properties in the aspect of antistatic property as compared with the above-mentioned other anionic surfactants, but their antistatic property under an extremely low humidity and their properties in the case where the amount thereof added is increased, have similar drawbacks to those of the above-mentioned alkylsulfate salt and alkylsulfonate salt type surfactants.

Further, in order to improve sizing property, generally the proportion of anionic surfactants in the lubricant may be increased, but this case also exhibits similar drawbacks to the above-mentioned. Further, in the case where polymers having a number of carboxyl groups in the molecule such as copolymers of maleic anhydride with a water-soluble vinyl monomer or alkali metal salts or ammonium salts of polyacrylic acid, etc. are used as a fiber-treating agent, they exhibit an excellent effectiveness of improving collecting property, but, on the other hand, friction of fibers to metals at high speed is very great, and also such carboxylic acid salts of polymers have almost no antistatic effectiveness.

DISCLOSURE OF THE INVENTION

In view of the above-mentioned various points, the present inventors have made strenuous studies for obtaining a fiber-treating lubricant which can notably inhibit the static build-up phenomenon of synthetic fibers even under a condition of an atmosphere of extremely low humidity to thereby notably alleviate static troubles at various steps, and at the same time can prevent the attrition of guides, pins, etc. in contact with fiber filaments running at a high speed, and also is superior in the collecting property and lubricating property. As a result the present inventors have found that (poly)ethylenepolyaminepolyacetic acid derivatives exhibit a superior antistatic property even under the above-mentioned extremely low humidity and are notably effective also in the attrition to metals and collecting property, and have attained the present invenion.

The object of the present invention is to provide a fiber-treating lubricant which effectively inhibits the static electricity generated by friction of fiber filaments to guides, rolls, heaters, etc. during the production and processing steps of synthetic fibers, even under an extremely low humidity (RH: 30% or lower); prevents the attrition of frictional bodies such as guides, pins, etc. in contact with fiber filaments to be treated at a high speed; and also imparts a high extent of lubricating property and collecting property to fiber filaments.

Namely the present invention is directed to a lubricant (or an oiling agent) for treating synthetic fibers (hereinafter referred to as treating lubricant of the present invention), characterized in that it contains a (poly)ethylenepolyaminepolyacetic acid derivative (hereinafter referred to as compound of the present invention) expressed by the following general formula (I), in a composition comprising so far known mineral oil, ester or polyglycol lubricating agents and nonionic surfactants or ionic surfactants, etc.:

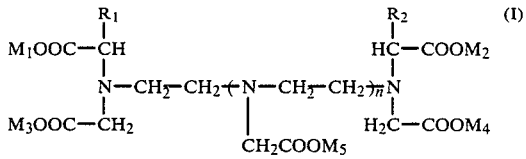

(I)

wherein the symbols have the following meanings:

$R_1$, $R_2$: hydrogen atom or alkyl or alkenyl group of 1 to 22 carbon atoms;

$M_1$, $M_2$: a single member or a mixture of the following members (1) to (6):

(1) hydrogen atom or alkali metal cation, (2) mono-, di- or tri(hydroxyalkyl)amine (the alkyl group having 2 to 4 carbon atoms), (3) mono-, di- or trialkyl (and/or alkenyl)amine (the alkyl group and alkenyl group having 1 to 22 carbon atoms), (4) secondary or tertiary amine having the hydroxyalkyl group and the alkyl group (and/or alkenyl group) in the amines of said (2) and (3) bonded to the nitrogen atom, (5) addition product of ethylene oxide (and/or propylene oxide) to a compound having an active hydrogen atom among the compounds of said (2), (3) and (4) (the polymerization degree of ethylene oxide and/or propylene oxide being 1 to 20), and (6) polyethylenepolyamine (the number of ethylene group being 1 to 5); and n: integer of 0 to 4.

Concrete examples of the compounds of the present invention are as follows, but the present invention is not limited only thereto:

(A) Sodium salt of ethylenediaminotetraacetic acid

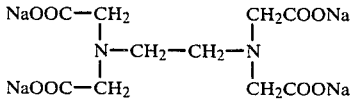

(B) Triethanolamine salt of diethylenetriamine-pentaacetic acid

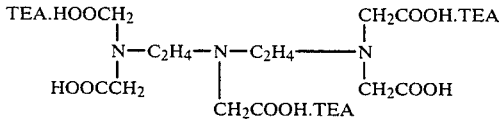

wherein TEA: triethanolamine

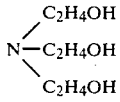

(C) Sodium salt of N,N'-bis(1-carboxyheptadecenyl)-tetraethylenepentamineacetic acid

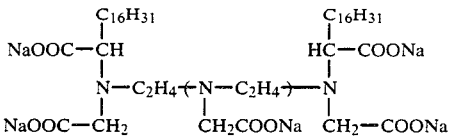

(D) Potassium salt of N,N'-bis(1-carboxydecyl)ethylenediaminediacetic acid

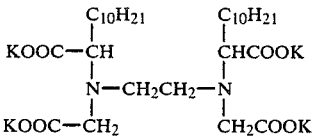

(E) Mixed salt of ethylenediaminetetraacetic acid and diethanolamine

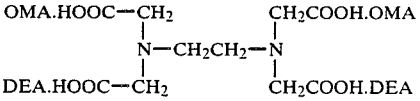

wherein OMA: oleylmethylamine

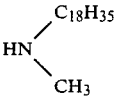

DEA: diethanolamine $HN(C_2H_4OH)_2$ (F) Oleylmethylamine-sodium mixed salt of diethylenetriaminepentaacetic acid

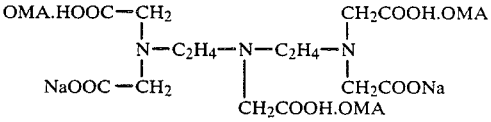

wherein OMA: oleylmethylamine (G) Laurylamine salt of N,N'-bis(1-carboxynonyl)ethylenediaminediacetic acid

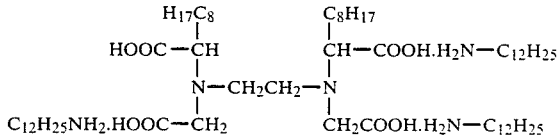

(H) Dibutylethanolamine salt of triethylenetetraminehexaacetic acid

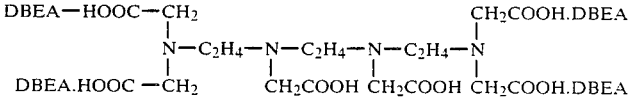

wherein DBEA:

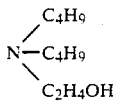

(I) Diethylenetriamine salt of N-(1-carboxyheptadecenyl)ethylenediaminetriacetic acid

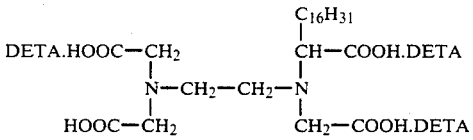

wherein DETA: diethylenetriamine:

$H_2N—C_2H_4—NH—C_2H_4—NH_2$ (J) Triethanolamine salt of tetraethylenepentaminehepta acetic acid

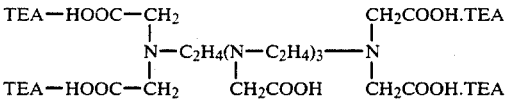

wherein TEA:

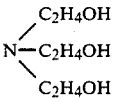

(K) POE (6) octylaminoether salt of ethylenediaminetetraacetic acid

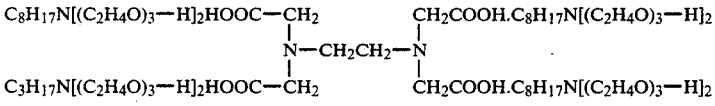

The present invention provides a fiber-treating lubricant having a (poly)ethylenepolyaminepolyacetic acid derivative blended therein as an antistatic agent component, and the blending proportion of the compound has no particular limitation, but essentially the proportion may be in a range in which the effectiveness of the present invention can be exhibited; its content in the treating lubricant is usually in the range of 0.1 to 50% by weight, preferably in the range of 0.5 to 20% by weight.

The lubricating agent used together with the compound of the present invention in the treating lubricant of the present invention can be selected from among purified mineral oils, synthetic fatty acid esters and polyoxyalkylene glycols. As the purified mineral oils, those having a Redwood kinetic viscosity at 30° C. of 40 to 500 seconds may be used, and as the synthetic fatty acid esters, esters of aliphatic monobasic acids with aliphatic monohydric alcohols, esters of polyols such as ethylene glycol, diethylene glycol, neopentyl glycol, trimethylolpropane, glycerol, pentaerythritol, etc. with aliphatic monobasic acids or esters of aliphatic dibasic acids with aliphatic monohydric alcohols may be used.

Further concrete examples of the above-mentioned synthetic fatty acid esters are as follows:

butyl stearate, n-octyl palmitate, 2-ethylhexyl palmitate, oleyl laurate, isohexadecyl laurate, isostearyl laurate, dioctyl sebacate, diisotridecyl adipate, ethylene glycol dioleate, trimethylolpropane trioctanoate, pentaerythritol tetraoctanoate. Further, as examples of polyoxyalkylene glycols, those obtained by subjecting propylene oxide and ethylene oxide to random or block addition polymerization to butanol, octanol, lauryl alcohol, stearyl alcohol or the like, those obtained by subjecting propylene oxide and ethylene oxide to random or block addition polymerization to propylene glycol, trimethylolpropane, glycerol, pentaerythritol, sorbitol or the like, etc., having various molecular weights, may be used.

Next, examples of nonionic surfactants used together with the compounds of the present invention in the lubricant of the present invention are polyoxyethylene alkyl ethers, polyoxyethylene alkyl phenyl esters, partial alkyl esters of polyols, etc.

Further, emulsification modifier, wetting agent, mildewproofing agent, rustproofing agent, etc. may be added to the above-mentioned various blend compositions, and the total amount of these additives is preferred to be 5% by weight or less based on the total blend composition.

The treating lubricant of the present invention, when applied to synthetic fibers as spinning lubricant or finishing lubricant, exhibits its effectiveness, and the lubricant, when used, is preferably attached to synthetic fibers in the form of an aqueous emulsion of 5 to 30% or in the form of a liquid obtained by diluting it with an organic solvent such as hydrocarbons, etc.

The treating lubricant of the present invention exhibits its effectiveness in the production and processing steps of thermoplastic synthetic fibers such as polyamides, polyesters, polypropylene, etc., and it is particularly effective as spinning lubricant for polyester or polyamide filaments.

The present invention will be further described by way of Examples.

EXAMPLES 1-5 AND COMPARATIVE EXAMPLES a-g

Using the compounds (G) and (H) of the present invention as an antistatic agent, treating agents 1-5 of the present invention having compositions indicated in Table 1 were prepared. On the other hand, as Comparative examples, using 4 kinds of ionic surfactants indicated in Table 1, which have so far been used as an antistatic agent, fiber-treating lubricants a-g indicated in the Table were prepared.

With these lubricants, (1) antistatic property in an atmosphere of medium humidity, (2) antistatic property in an atmosphere of extremely low humidity, (3) fiber to metal kinetic frictional coefficient, and (4) fiber to fiber kinetic frictional coefficient were tested, followed by evaluation.

Blending of lubricants and results of tests carried out with the resulting blends are shown in Table 1.

As seen from Table 1, conventional antistatic agents are not yet sufficient in the antistatic property and also certain drawbacks are observed in other properties, whereas the treating lubricants of the present invention using the compounds of the present invention are notably superior in the antistatic property not only in an atmosphere of medium humidity, but also in an atmosphere of extremely low humidity, and in addition, other properties are not adversely affected.

TABLE 1

| Lubricant No. | Example 1 | 2 | 3 | 4 | 5 | Comparative example a | b | c | d | e | f | g |
|---|---|---|---|---|---|---|---|---|---|---|---|---|
| Lubricant component | | | | | | | | | | | | |
| PO/EO (50/50) monooctyl ether (M.W. 2,000, random addition) | 35 | 35 | 35 | 35 | 35 | 35 | 35 | 35 | 35 | 35 | 35 | 35 |
| PO/EO (50/50) glyceryl ether (M.W. 4,000, random addition) | 40 | 40 | 40 | 40 | 40 | 40 | 40 | 40 | 40 | 40 | 40 | 40 |
| POE (5) lauryl ether | 8 | 8 | 10 | 125 | 10 | 5 | 10 | 10 | 10 | 10 | 10 | 10 |
| POE (20) hardened castor oil ether | 12 | 12 | 12 | 12 | 10 | 10 | 10 | 10 | 10 | 10 | 145 | 145 |
| *Compound of present invention (G) | 5 | | | | 1 | | | | | | | |
| Compound of present invention (H) | | 5 | 3 | 0.5 | 1 | | | | | | | |
| Potassium oleate salt | | | | | | 10 | 5 | | | | | |
| POE (5) laurylphosphatetriethanolamine salt | | | | | | | | 5 | | | | |
| Sodium laurylsulfonate salt | | | | | 3 | | | | 5 | | 0.5 | |
| Oleylimidozoline quaternary salt | | | | | | | | | | 5 | | 0.5 |
| Test results | | | | | | | | | | | | |
| Amount of lubricant attached (based on wt. % of fiber) | 0.48 | 0.48 | 0.46 | 0.48 | 0.48 | 0.48 | 0.48 | 0.47 | 0.46 | 0.48 | 0.52 | 0.49 |
| (1) Antistatic property in medium humidity atmosphere (20° C., 65% RH) | | ◎ | ◎ | ◎ | ◎ | ◎ | ○ | Δ | ◎ | ○ | Δ | x |
| (2) Antistatic property in extremely low humidity atmosphere (20° C., 25% RH) | ◎ | ◎ | ◎ | ○ | ○ | Δ | x | x | Δ | x | x | x |
| (3) Fiber to metal kinetic frictional coefficient | ○ | ○ | ○ | ◎ | ○ | x | Δ | Δ | Δ | Δ | ○ | ○ |
| (4) Fiber to fiber kinetic frictional coefficient | ○ | ○ | ○ | ◎ | ○ | x | Δ | Δ | Δ | Δ | ○ | ○ |

Numerals in the Table represent the amounts of respective components blended (% by weight).
*Compounds (G) and (H) of the present invention are the same as those described above.

Tests of the properties (1), (2), (3) and (4) in Table 1 were carried out according to the following methods and the results were evaluated with symbols shown on the right side of the respective testing methods:

(1) Antistatic property in an atmosphere of a medium humidity:

A lubricant to be tested was attached to multifilament of polyester stretched yarn SD (semidull) 75 deniers/36 filaments, in an amount of 0.5±0.1%, and subjected to moisture conditioning in an atmosphere of 65% RH at 20° C. to obtain a sample yarn.

This sample yarn was supplied into a measurement room having an atmosphere of 65% RH at 20° C., under an initial tension of 20 g and at a yarn speed of 300 m/min.; thereafter contacted with a stainless heater of 90 cm long kept at 200° C.; thereafter further contacted in frictional manner with a chrome-satinized frictional body at a contact angle of 90°; and subjected to measurement of electricity generated on the filaments by means of a collector type charge gauge (manufactured by Kasuga Denki) provided just therebehind.

Evaluation standard:

| | | |
|---|---|---|
| ◎ | static build-up voltage | 0–50 volt |
| ○ | " | 51–100 volt |
| Δ | " | 101–500 volt |
| x | " | higher than 500 volt |

(2) Antistatic property in an atmosphere of an extremely low humidity;

A sample yarn oiled under the same conditions as those of the above (1) and at the same time was subjected to moisture conditioning under 25% RH at 20° C. to obtain a sample yarn to be tested. This sample yarn was subjected to measurement of electricity generated on the filaments according to the same method and conditions as in the above (1) except that the atmosphere during the measurement was 25% RH.

Evaluation standard is the same as in the above (1).

(3) Fiber to metal kinetic frictional coefficiency:

A sample yarn prepared in the same manner as in the case of the above-mentioned measurement of antistatic property, was measured according to the following method by means of $\mu$ meter (manufactured by Eiko Sokki):

A yarn supplied under an initial tension ($T_1$) of 20 g and at a speed of 100 m/min. was contacted in frictional manner with a chrome-satinized pin at a contact angle of 90° in an atmosphere of 25% RH at 20° C., and a tension ($T_2$) just after passage through the frictional body was recorded, followed by calculating the kinetic frictional coefficient according to the following equation:

$$\mu = \frac{1}{\theta} \ln T_2/T_1$$

$\theta$: contact angle
ln: natural logarithm

The higher the $\mu$ value in this method is, the more the tension on the surface of contact of the yarn is liable to rise and vary.

Evaluation standard:

| | | |
|---|---|---|
| ◎ | | $\mu \leqq 0.27$ |
| ○ | $0.27 <$ | $\mu \leqq 0.30$ |
| Δ | $0.30 <$ | $\mu \leqq 0.33$ |
| x | $0.33 <$ | $\mu$ |

(4) Fiber to fiber kinetic frictional coefficient:

A sample yarn prepared in the same manner as in the case of the above-mentioned measurement of antistatic property, was measured under the following conditions by means of a radar type fiber friction meter (manufactured by Aoi Seiki):

| | |
|---|---|
| Initial tension | 100 mg |
| Drum-peripheral speed of sample yarn | 18 m/min. |
| Moisture conditioning and atmosphere measured 20° C., | 25% RH |

The higher the $\mu$ value in this method is, the more the twisting property on a twister such as double twister or the unwinding property out of pirn, cheese, etc. is liable to be inferior.

Evaluation standard:

| | | |
|---|---|---|
| ◎ | | $\mu \leqq 0.29$ |
| ○ | $0.29 <$ | $\mu \leqq 0.34$ |
| Δ | $0.34 <$ | $\mu \leqq 0.39$ |
| x | $0.39 <$ | $\mu$ |

EXAMPLES 6–14 AND COMPARATIVE EXAMPLES h–j

| | |
|---|---|
| Diisotridecyl adipate | 30% by weight |
| PO/EO (25/75) oleyl ether (M.W. 2,500, block addition product) | 45% by weight |
| POE (10) nonylphenyl ether | 15% by weight |
| PEG 400 dilaurate | 8% by weight |
| Antistatic agent | 2% by weight |

To the above basic composition were blended the compounds of the present invention (A)–(F), (I), (J) and (K) as an antistatic agent, respectively to prepare treating lubricants of the present invention 6–14, and similarly lubricants h–j of Comparative examples were prepared. They were then attached to a multifilament of polyester filament-stretched yarn SD, 150 deniers and 30 filaments, in the form of a 15% aqueous emulsion and in an amount of 0.4±0.1%, followed by moisture conditioning in an atmosphere of 30% RH at 25° C.

These sample yarns were subjected to a false twist processing in the same atmosphere, under the conditions of a yarn speed of 160 m/min., a number of spindle revolutions of 400,000 r.p.m. and a heater temperature of 215° C. (heater length: 1.5 m), and the static build-up voltage of the running yarn just after the passage through a delivery roller was measured by a static charge gauge manufactured by Kasuga Denki. The results are shown in Table 2.

As apparent from the results of Table 2, the treating lubricants of the present invention using an antistatic agent of the present invention exhibit superior antistatic property to that of lubricants of Comparative examples using antistatic agents which have so far been regarded as effective under an extremely low humidity.

TABLE 2

| | Lubricant No. | Antistatic agent | static build-up voltage of filaments |
|---|---|---|---|
| Example | 6 | Compound of (A) present invention | ○ |
| | 7 | Compound of (B) present invention | ○ |
| | 8 | Compound of (C) present invention | ○ |
| | 9 | Compound of (D) present invention | ○ |
| | 10 | Compound of (E) present invention | ○ |
| | 11 | Compound of (F) present invention | ○ |
| | 12 | Compound of (I) present invention | ○ |
| | 13 | Compound of (J) present invention | ○ |
| | 14 | Compound of (K) present invention | ○ |
| Compar. ex. | h | Sodium laurylsulfonate salt | Δ |
| | i | Potassium oleate salt | Δ |
| | j | Oleylimidazoline quaternary salt | x |

(A), (B), (C), (D), (E), (F), (I), (J) and (K) of the present invention are the same as the compounds as concrete examples listed above.

Evaluation standard:

| | | |
|---|---|---|
| ◎ | static build-up voltage | 0–150 volt |
| Δ | " | 151–300 volt |
| x | " | 300 < volt |

EXAMPLES 15–17 AND COMPARATIVE EXAMPLES k–l

Treating lubricants of the present invention 15–17 using the compound (E) of the present invention as an antistatic agent, shown in Table 3 and lubricants k–l of Comparative examples also shown therein were prepared, and they were attached in the form of a solution thereof in a liquid paraffin having a boiling point of 250° C., to nylon 6 filaments (SD-70 deniers, 18 filaments) in an amount of 1.0±0.1%, followed by moisture conditioning in an atmosphere of 25% RH at 25° C. to prepare sample yarns. These sample yarns were tested and evaluated relative to (1) antistatic property and (2) lubricating property (fiber to metal frictional coefficient), according to the methods described later.

Blending of the lubricants and the results of the tests carried out therewith are shown in Table 3.

As apparent from the results of Table 3, the treating lubricants of the present invention exhibit superior antistatic property even under an extremely low humidity and further, other properties are not adversely affected, whereas in the case of the lubricants of Comparative examples using antistatic agents other than the compounds of the present invention, certain drawbacks are observed; hence the treating lubricants of the present invention are superior.

TABLE 3

| | Example | | | Compar. ex. | |
|---|---|---|---|---|---|
| Lubricant No. | 15 | 16 | 18 | k | l |
| Lubricant component | | | | | |
| 40 Seconds mineral oil | 30 | 30 | 15 | 30 | 30 |
| Isooctyl stearate | 35 | 30 | 30 | 35 | 35 |
| POE (20) sorbitan trioleate | 25 | 20 | 15 | 25 | 25 |
| Compound of present invention (E) | 10 | 20 | 40 | | |
| Potassium oleate salt | | | | 10 | |
| Oleylimidazoline quaternary salt | | | | | 10 |
| Test results | | | | | |
| (1) Antistatic property | ◎ | ◎ | ◎ | Δ | Δ |
| (2) Fiber to metal frictional coefficient | ◎ | ○ | ○ | x | x |

Numerals in the Table represent the amounts of the respective components blended in the lubricants (% by weight).

Tests and evaluations of the respective properties in Table 3 were carried out according to the following methods:

(1) Antistatic property:

The above sample yarns were supplied under an initial tension of 20 g and at a speed of 300 m/min. in an atmosphere of 25% RH at 20° C., and contacted in frictional manner with a frictional body of 25 mm in diameter, having its surface chrome-satinized, at a contact angle of 90°, followed by measuring electricity generated on the filaments by means of a collector type charge gauge (manufactured by Kasuga Denki) provided just therebehind.

Evaluation standard:

| | |
|---|---|
| ◎: static build-up voltage | 0–50 volt |
| ○: static build-up voltage | 51 –100 volt |
| Δ: static build-up voltage | 101–500 volt |
| x: static build-up voltage | 500 < volt |

(2) Fiber to metal frictional coefficient:

As in the case of measurement of antistatic property in the above (1), the above-mentioned sample yarns were subjected to measurement of antistatic property by means of $\mu$ meter (manufactured by Eiko Sokki) according to the following method:

A yarn supplied under an initial tension ($T_1$) of 20 g and at a speed of 300 m/min. was contacted in frictional manner with a chrome-satinized pin at a contact angle of 90°, and a tension ($T_2$) just after passage through the frictional body was recorded, followed by calculating the kinetic frictional coefficiency according to the following equation:

$$\mu = \frac{1}{\theta} \ln T_2/T_1$$

$\theta$: contact angle
ln: natural logarithm

Evaluation standard:

| | | |
|---|---|---|
| ◎ | | $\mu \leqq 0.25$ |
| ○ | 0.25 < | $\mu \leqq 0.28$ |
| Δ | 0.28 < | $\mu \leqq 0.31$ |
| x | 0.31 < | $\mu$ |

EXAMPLES 18–19 AND COMPARATIVE EXAMPLES m–p

Treating lubricants of the present invention 18 and 19 using the compounds of the present invention (E) and (J) as an antistatic agent, shown in Table 4, and lubricants m–p of Comparative examples also shown in Table 4, were prepared. With these lubricants, the properties of (1) foaming property, (2) antifrictional property to metal, (3) electricity generated on the filaments, and (4) collecting property were tested and evaluated according to the methods as mentioned later.

Blending of the lubricants and the results of tests carried out relative thereto are shown in Table 4.

As apparent from Table 4, conventional antistatic agents are not yet sufficient in the antistatic property in an atmosphere of an extremely low humidity, and also certain drawbacks are observed in other properties, whereas the treating lubricants of the present invention using the compounds of the present invention exhibit a notable antistatic property even under severe conditions as in the present experiment, and further, other properties are also superior; hence the treating lubricants of the present invention are superior.

TABLE 4

| | Example | | Compar. ex. | | | |
|---|---|---|---|---|---|---|
| Lubricant No. | 18 | 19 | m | n | o | p |
| Lubricant component | | | | | | |
| 60 Seconds mineral oil | 40 | 40 | 40 | 40 | 40 | 40 |
| Isooctyl stearate | 25 | 25 | 25 | 25 | 25 | 25 |
| POE (10) castor oil | 10 | 10 | 10 | 10 | 10 | 10 |
| POE (10) oleate | 10 | 10 | 10 | 10 | 10 | 10 |
| Compound of present invention (E) | 15 | | | | | |
| Compound of present invention (J) | | 15 | | | | |
| Potassium oleate salt | | | 15 | | | |
| POE (4) oleylphosphate Na salt | | | | 15 | | |
| Polyacrylic acid methyl ester partially saponified product ammonium salt (saponification degree, 25%; M.W. 3,000) | | | | | 15 | |
| Alkylsulfonate Na salt | | | | | | 15 |
| Test results | | | | | | |
| (1) Foaming property | ◎ | ◎ | x | x | Δ | x |
| (2) Antifrictional property to metal | ◎ | ◎ | ◎ | x | ○ | ○ |
| (3) Electricity generated on filaments | ○ | ○ | Δ | x | x | Δ |
| (4) Collecting property | ○ | ○ | x | Δ | ○ | x |

Numerals in the Table represent the amounts of the respective components blended in the lubricants (% by weight).

Tests and evaluations of the respective properties in Table 4 were carried out according to the following methods:

(1) Foaming property:

Ross-Miles test: 200 ml of a 15% emulsion of a lubricant to be tested is dropped from a height of 90 cm, and the height (ml) of foams after 3 minutes lapsed since the dropping is measured.

Liquid temperature: 40±1° C.

Evaluation standard:

| | |
|---|---|
| ◎: height of foams | 1 ml or less |
| ○: height of foams | more than 1 ml and 5 ml or less |
| Δ: height of foams | more than 5 ml and 10 ml or less |
| x: height of foams | more than 10 ml |

(2) Antifrictional property to metal:

Lubricants to be tested were attached to a multifilament of polyester stretched yarn SD 75 deniers/36 filaments, in an amount of 1.1±0.1%, followed by moisture conditioning in an atmosphere of 25% RH at 20° C. to prepare a sample yarn. It was run in contact with a knitting needle at a contact angle of 170°, under an initial tension of 15 g, at a yarn speed of 100 m/min. in an atmosphere of 25% RH at 20° C., and after 3 hours, the surface of the knitting needle was observed by means of a microscope.

As for the judgement, whether the antifrictional property was good or not was determined by the presence or absence of attrition streak.

Evaluation standard:

| |
|---|
| ◎: attrition streak, none |
| ○: attrition streak, slightly present |
| Δ: attrition streak, present |
| x: attrition streak, notably present |

(3) Evaluation of electricity generated on filaments:

Sample yarns prepared in the same manner as in the case of Examples 6–14 are evaluated according to the following method:

One thousand ends of these sample yarns were at the same time taken up from a creel stand, via a creel guide, onto a beam, at a yarn speed of 100 m/min. in an atmosphere of 25% RH at 20° C., and the electricity generated on filaments just after passage through the creel guide was measured by means of a collector type static charge gauge (manufactured by Kasuga Denki).

Evaluation standard:

◎: 0–200 volt
○: 201–400 volt
Δ: 401–600 volt
x: 600 < volt

In addition, in the case of sample yarns on which 600 volt or higher of static electricity was generated at the time of this measurement, fiber breakage due to approach of filaments was observed.

(4) Evaluation of collecting property:

Sample yarns prepared in the same manner as in the case of Examples 6–14 were evaluated according to the following method:

Sample yarns were drawn out of a cheese at a running speed of 10 m/min., and the number of loops generated just after passage through a washer tenser of 20 g was evaluated.

Evaluation standard:

○: loop of running filaments 0/min.
Δ: loop of running filaments 1–3/min.
x: loop of running filaments 4 or more/min.

EXAMPLES 20–27 AND COMPARATIVE EXAMPLES q–u

Treating agents of the present invention 20–27 using the compounds of the present invention (B), (E) and (K), shown in Table 5, and lubricants q–u of Comparative examples were prepared. Using these lubricants, polyester POYs (partially oriented yarn) (115 deniers, 36 filaments) were obtained. Next, these filaments were subjected to stretching and false twist by means of a stretching and false twisting machine provided with a triaxial friction disc type twist-hanging means, and (1) static build-up voltage of filaments and (2) tar on a heat set heater, at that time were tested and evaluated. As a result, in the case of the lubricants of the present invention, static build-up voltage of filaments was low and the amount of heater tar was small to exhibit a long-term stabilized operability, whereas in the case of conventional lubricants of Comparative examples, drawbacks were found in either of the two tests to make it impossible to exhibit a long-term stabilized operability.

Prepartion of polyester POY

Just after melt-spinning of polyethylene terephthalate, the above-mentioned lubricants in the form of a 10% aqueous solution thereof were oiled thereto according to roller touch method (number of roller revolutions: 15 r.p.m.), respectively, and taken up at a speed of 3,500 m/min. to obtain POY of 115 deniers and 36 dilaments.

Stretching and false twist conditions:

Twist manner: triaxial friction manner (urethane rubber-made)

Running speed of filaments: 600 m/min.

Stretch ratio: 1.518

Heater on the twist side: stainless steel-made, length 2.0 m, surface temperature 230° C.

Heater on the side of untwisting: none

Number of twists aimed: 3,500 T/m.

Evaluation method:

(1) Static build-up voltage of filaments:

A static charge gauge (manufactured by Kasuga Denki) was placed facing the surface of a cheese of false twisted yarn taken up just after stretching and false twist, and the voltage was measured during the take-up.

Evaluation standard:

o: lower than 200 volt
Δ: 200 volt or higher-500 volt or lower
×: higher than 500 volt Yarns having a higher static build-up voltage are liable to cause troubles such as coiling of filaments round delivery roller.

(2) Heater tar:

After a continuous operation under the above stretching and false twist conditions for 10 days, the surface of the heater was observed with naked eyes.

Evaluation standard:

o: The trace of the yarn path is observed, but deposit is scarely observed.
Δ: Brown deposit is observed on the yarn path.
×: A large amount of brown-black deposit is observed on the yarn path and in the vicinity thereof.

The more the amount of heater tar is, the more often breakage of running filaments occurs during the operation.

TABLE 5

| | Example | | | | | | | | Compar. ex. | | | | |
|---|---|---|---|---|---|---|---|---|---|---|---|---|---|
| Component | 20 | 21 | 22 | 23 | 24 | 25 | 26 | 27 | q | r | s | t | u |
| Composition | | | | | | | | | | | | | |
| PO/EO (65/35) mono Bu ether (MW = 2,000) | 69 | 69 | 69 | 69 | 69 | 69 | 63 | 63 | 69 | 69 | 69 | 69 | 69 |
| PO/EO (65/35) mono Bu ether (MW = 700) | 30 | 30 | 30 | 30.5 | 30 | | | | 30 | 30 | 30 | 30.5 | 30 |
| PO/EO (50/50) monooctyl ether (MW = 5,000) | | | | | | 30 | | | | | | | |
| POE (5) lauryl ether decanate | | | | | | | 35 | 35 | | | | | |
| Compound of present invention (B) | 1 | | | 0.5 | 0.5 | 0.5 | 1 | 2 | | | | | |
| Compound of present invention (E) | | 1 | | | | | | | | | | | |
| Compound of present invention (K) | | | 1 | | | | | | | | | | |
| Na alkyl ($C_{12}$–$C_{14}$) sulfonate | | | | | 0.5 | | 0.5 | | 1 | | | 0.5 | 0.5 |
| K oleate | | | | | | 0.5 | | | | 1 | | | |
| K POE (3–5 mols) laurylphosphate | | | | | | | 0.5 | | | | | | |
| Test results | | | | | | | | | | | | | |
| Static build-up voltage of filaments | ○ | ○ | ○ | ◎ | ○ | ○ | ○ | Δ | ○ | x | x | x | |

TABLE 5-continued

| Component | Example 20 | 21 | 22 | 23 | 24 | 25 | 26 | 27 | Compar. ex. q | r | s | t | u |
|---|---|---|---|---|---|---|---|---|---|---|---|---|---|
| Heater tar | ○ | ○ | ○ | ○ | ○ | ○ | ○ | ○ | x | x | x | ○ | ○ |

What is claimed is:

1. A method for improving the antistatic properties of synthetic fibers which comprises coating the fibers with a composition containing a compound having the formula

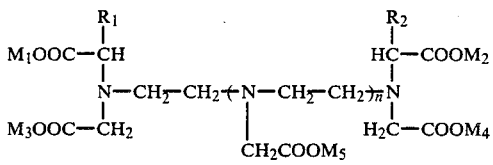

(I)

wherein:

$R_1$, $R_2$ is an alkyl group of 1 to 22 carbon atoms;

$M_1$–$M_5$ is one or more of the following members (1) to (6):

(1) a hydrogen atom or an alkali metal cation, (2) a mono-, di- or tri(hydroxyalkyl) amine, the alkyl group having 2 to 4 carbon atoms, (3) a mono-, di- or trialkyl amine, the alkyl group having 1 to 22 carbon atoms, (4) a secondary or tertiary amine having a hydroxyalkyl group wherein the alkyl group of 2–4 carbon atoms is bonded to the nitrogen atom, (5) an addition product of ethylene oxide and a compound having an active hydrogen atom among the compounds of said (2), (3) and (4), the polymerization degree of ethylene oxide being 1 to 20, and (6) a polyethylenepolyamine, the number of ethylene group being 1 to 5, and n is 0, 1, 2, 3 or 4.

2. A method according to claim 1 wherein said compound is the laurylamine salt of N,N'-bis(1-carboxylnonyl)-ethylenediamine diacetic acid.

3. A method according to claim 1 wherein said compound is the dibutylethanolamine salt of triethylenetetramine hexacetic acid.

4. A method according to claim 1 wherein n is 2, 3 or 4.

* * * * *